US010622764B2

(12) United States Patent
Maesoba et al.

(10) Patent No.: US 10,622,764 B2
(45) Date of Patent: Apr. 14, 2020

(54) CONNECTOR STRUCTURE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/340,419

(22) PCT Filed: Sep. 21, 2017

(86) PCT No.: PCT/JP2017/034003
§ 371 (c)(1),
(2) Date: Apr. 9, 2019

(87) PCT Pub. No.: WO2018/070201
PCT Pub. Date: Apr. 19, 2018

(65) Prior Publication Data

US 2019/0296491 A1 Sep. 26, 2019

(30) Foreign Application Priority Data

Oct. 12, 2016 (JP) ..... 2016-200511

(51) Int. Cl.
*H01R 24/00* (2011.01)
*H01R 13/6463* (2011.01)
(Continued)

(52) U.S. Cl.
CPC ..... *H01R 13/6463* (2013.01); *H01R 13/6474* (2013.01); *H01R 13/6585* (2013.01); *H01R 24/60* (2013.01)

(58) Field of Classification Search
CPC ..... H01R 24/60; H01R 13/6463; H01R 13/6474; H01R 13/6585
(Continued)

(56) References Cited

U.S. PATENT DOCUMENTS 4,702,538 A * 10/1987 Hutter ..... H01R 24/84 439/292
4,786,257 A * 11/1988 Tengler ..... H01R 13/6585 439/497
(Continued)

FOREIGN PATENT DOCUMENTS

JP 2009-135122 6/2009
JP 5087487 12/2012
(Continued)

OTHER PUBLICATIONS

International Search Report.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

It is aimed to provide a connector structure enabling the replacement of an STP cable (10B) and a UTP cable (10A) without making a large structural change. UTP connection terminals (21A) to be connected to respective wires (11) of a UTP cable (10A) have the same shape and are accommodated in a pair of accommodating portions (26) of a UTP dielectric (22A) such that insertion areas (53) for male terminals (91) are close to each other in a width direction. STP connection terminals (21B) to be connected to respective wires (11) of the STP cable (10B) have the same shape
(Continued)

and are accommodated into the pair of accommodating portions (26) of a STP dielectric (22B) such that insertion areas (53) for male terminals (91) are arranged more apart from each other in the width direction than in the case of the UTP connection terminals (21A).

2 Claims, 27 Drawing Sheets

(51) Int. Cl.
*H01R 13/6474* (2011.01)
*H01R 13/6585* (2011.01)
*H01R 24/60* (2011.01)

(58) Field of Classification Search
USPC ..... 439/676
See application file for complete search history.

(56) References Cited

U.S. PATENT DOCUMENTS 5,538,434 A * 7/1996 DelGuidice ..... H01R 4/2433 439/188
6,280,209 B1 8/2001 Bassler et al.
6,431,918 B1 * 8/2002 Givens ..... H01R 13/6461 439/676
6,439,920 B1 * 8/2002 Chen ..... H01R 4/2404 439/418
6,729,901 B2 * 5/2004 Aekins ..... H01R 13/6463 439/418
6,729,914 B2 * 5/2004 Jaouen ..... H01R 13/6461 439/676
6,896,557 B2 * 5/2005 Aekins ..... H01R 13/6461 439/676
6,962,503 B2 * 11/2005 Aekins ..... H01R 13/6463 439/418
7,037,140 B2 * 5/2006 Aekins ..... H01R 13/6461 439/676
7,448,920 B2 * 11/2008 Quenneville ..... H01R 13/6463 439/418
7,601,024 B2 * 10/2009 Martich ..... H01R 13/506 439/540.1
8,308,509 B2 * 11/2012 Karam ..... H01R 9/035 439/579
8,348,699 B2 * 1/2013 Nagawatari ..... H01R 13/6589 439/607.01
8,715,016 B2 * 5/2014 DeBock ..... H01R 13/514 439/701
8,758,047 B2 * 6/2014 Dietz ..... H01R 13/514 439/540.1
8,858,268 B2 * 10/2014 Hashim ..... H01B 11/04 439/676
9,520,210 B1 * 12/2016 Neveux ..... G02B 6/4495
9,805,844 B2 * 10/2017 Bopp ..... H01B 11/08
10,297,932 B2 * 5/2019 Maesoba ..... H01R 13/6477
2011/0136391 A1 6/2011 Kameyama
2011/0280528 A1 * 11/2011 Wu ..... G02B 6/3817 385/101
2015/0200486 A1 7/2015 Yagi et al.
2017/0352989 A1 12/2017 Takahashi
2019/0252806 A1 * 8/2019 Maesoba ..... H01R 9/035
2019/0288456 A1 * 9/2019 Maesoba ..... H01R 13/187

FOREIGN PATENT DOCUMENTS

JP 5333632 11/2013
JP 2015-53194 3/2015
JP 2015-149189 8/2015
JP 2016-39046 3/2016
JP 2016-115625 6/2018
WO 2016/132855 8/2016

* cited by examiner

CONNECTOR STRUCTURE

BACKGROUND

Field of the Invention

The invention relates to a connector structure.

Related Art

A twisted pair cable formed by twisting wires and is used in an in-vehicle network and the like since it is affected less by noise and has less noise radiation than mere parallel wires. Twisted pair cables include STP (Shield Twisted Pair) cables and UTP (Unshield Twisted Pair) cables. STP cables have wires are surrounded by a shield conductor, and have a strong resistance to noise.

Japanese Patent No. 5333632 discloses a connector with inner conductor terminals to be connected to an end part of an STP cable, an inner housing (dielectric) for accommodating the inner conductor terminals, a shield shell connected to a shield conductor of the STP cable and surrounding the inner housing and an outer housing for accommodating the shield shell.

Japanese Patent No. 5087487 discloses a connector with connection terminals to be connected to an end part of a UTP cable and a connector body (dielectric) including a terminal accommodating portion for accommodating the connection terminals.

The connectors of Japanese Patent No. 5333632 and Japanese Patent No. 5087487 have a common configuration where wires of the UTP cable and STP cable are connected to the terminals and each terminal is accommodated in the dielectric. An ability to replace the STP cable by the UTP cable or replace the UTP cable by the STP cable while utilizing common structural parts in the respective connectors would facilitate mold design and reduce cos. However, there is no compatibility between the UTP cable and the STP cable and impedances of the UTP cable and the STP cable are different. Thus, sufficient attention has to be paid to this point.

The present invention was completed on the basis of the above situation and aims to provide a connector structure enabling the replacement of an STP cable and a UTP cable without making a large structural change.

SUMMARY

The invention is directed to a connector structure with UTP connection terminals and STP connection terminals. Each UTP connection terminal includes a box portion into which a male terminal is inserted and connected. The UTP connection terminals are connected to wires of a UTP cable. Each STP connection terminal includes a box portion into which a male terminal is inserted and connected. The STP connection terminals are connected to respective wires of a STP cable. A UTP dielectric includes accommodating portions for accommodating the UTP connection terminals, and an STP dielectric includes accommodating portions for accommodating the STP connection terminals. A pair of the accommodating portions of the UTP dielectric and a pair of the accommodating portions of the STP dielectric are arranged in a width direction perpendicular to an inserting direction of the male terminals. The UTP connection terminals have the same shape and are accommodated into the pair of accommodating portions of the UTP dielectric such that insertion areas for the male terminals in the box portions are close to each other in the width direction. The STP connection terminals have the same shape and are accommodated into the pair of accommodating portions of the STP dielectric such that insertion areas for the male terminals in the box portions are arranged more apart from each other in the width direction than in the case of the UTP connection terminals.

If the UTP connection terminals are accommodated into the pair of accommodating portions and the male terminals are inserted and connected into the insertion areas for the male terminals, the male terminals are arranged close to each other in the width direction. Thus, impedance can be reduced. On the other hand, if the STP connection terminals are accommodated into the pair of accommodating portions and the male terminals are inserted and connected into the insertion areas for the male terminals, the male terminals are arranged apart from each other in the width direction. Thus, impedance can be increased. In this way, the impedance can be adjusted properly between the UTP cable and the STP cable.

The UTP connection terminals to be accommodated into the pair of accommodating portions have the same shape, and the STP connection terminals to be accommodated into the pair of accommodating portions have the same shape. Additionally, the structures of the UTP dielectric (dielectric including the accommodating portions for accommodating the UTP connection terminals) and the STP dielectric (dielectric including the accommodating portions for accommodating the STP connection terminals) need not be very different if a separation distance in the width direction of the insertion areas for the male terminals is adjusted. Thus, the STP cable and the UTP cable can be replaced easily without accompanying a large structural change.

A receiving portion and a resilient contact piece facing the receiving portion may be arranged in the box portion, and the resilient contact piece may project more into the box portion than the receiving portion. Additionally, the male terminal may be sandwiched between the receiving portion and the resilient contact piece, the UTP connection terminals may be accommodated in the pair of accommodating portions of the UTP dielectric. Thus, the receiving portions are located on inner sides proximate in the width direction and the resilient contact pieces are located on outer sides spaced apart in the width direction. Furthermore, the STP connection terminals may be accommodated in the pair of accommodating portions of the STP dielectric such that the receiving portions are located on outer sides spaced apart in the width direction and the resilient contact pieces are located on inner side proximate in the width direction. According to this configuration, impedance easily can be easily adjusted merely by reversing a positional relationship of the resilient contact pieces and the receiving portions between the UTP cable side and the STP cable side.

DETAILED DESCRIPTION

Figure 1:
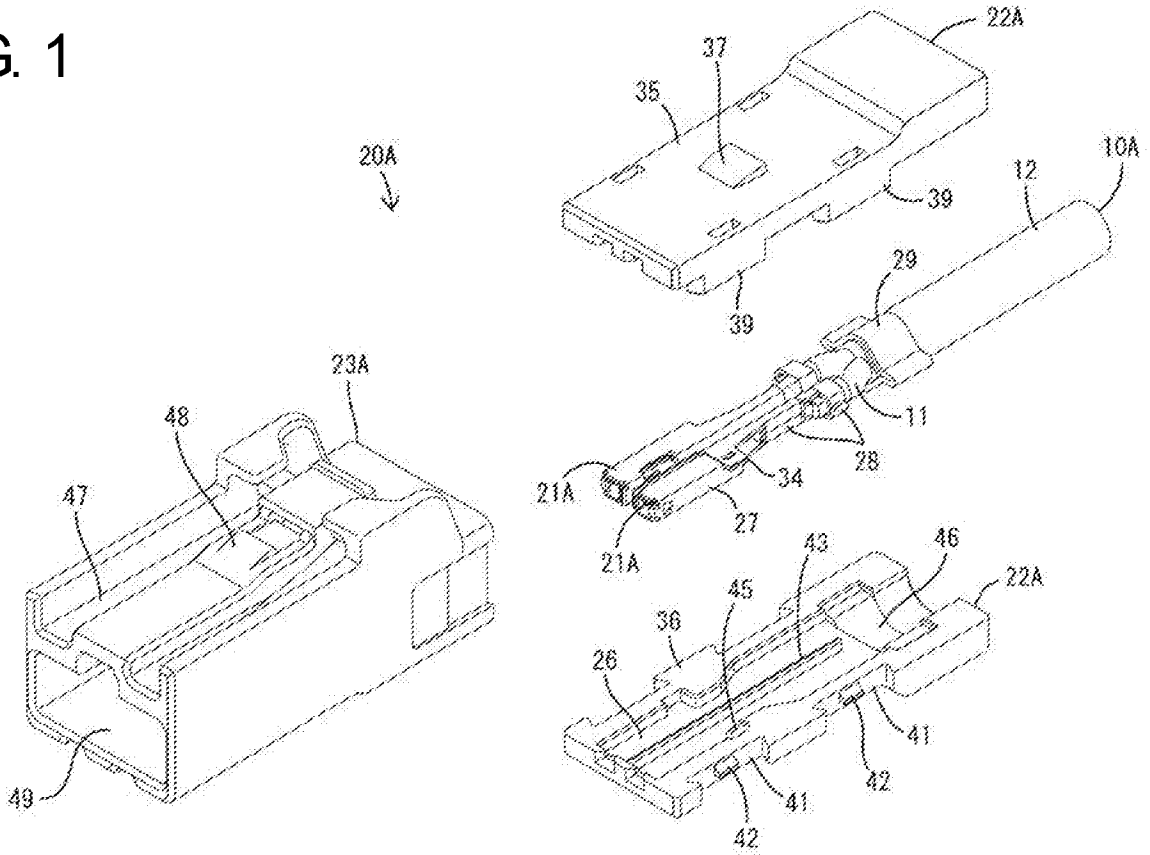
FIG. 1 is an exploded perspective view of a UTP connector in a connector structure of one embodiment of the present invention.
Figure 6:
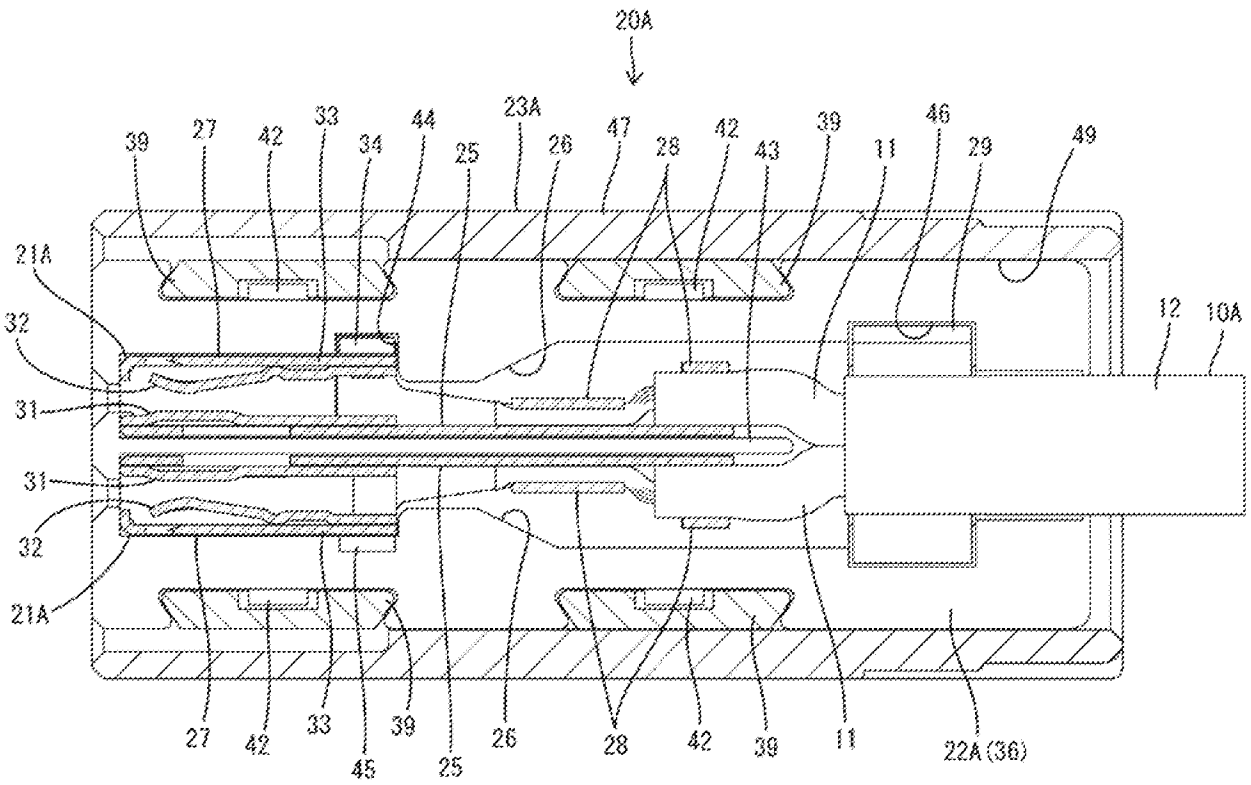
FIG. 6 is a section of the UTP dielectric and the UTP connection terminals accommodated in the UTP housing.
Figure 13:
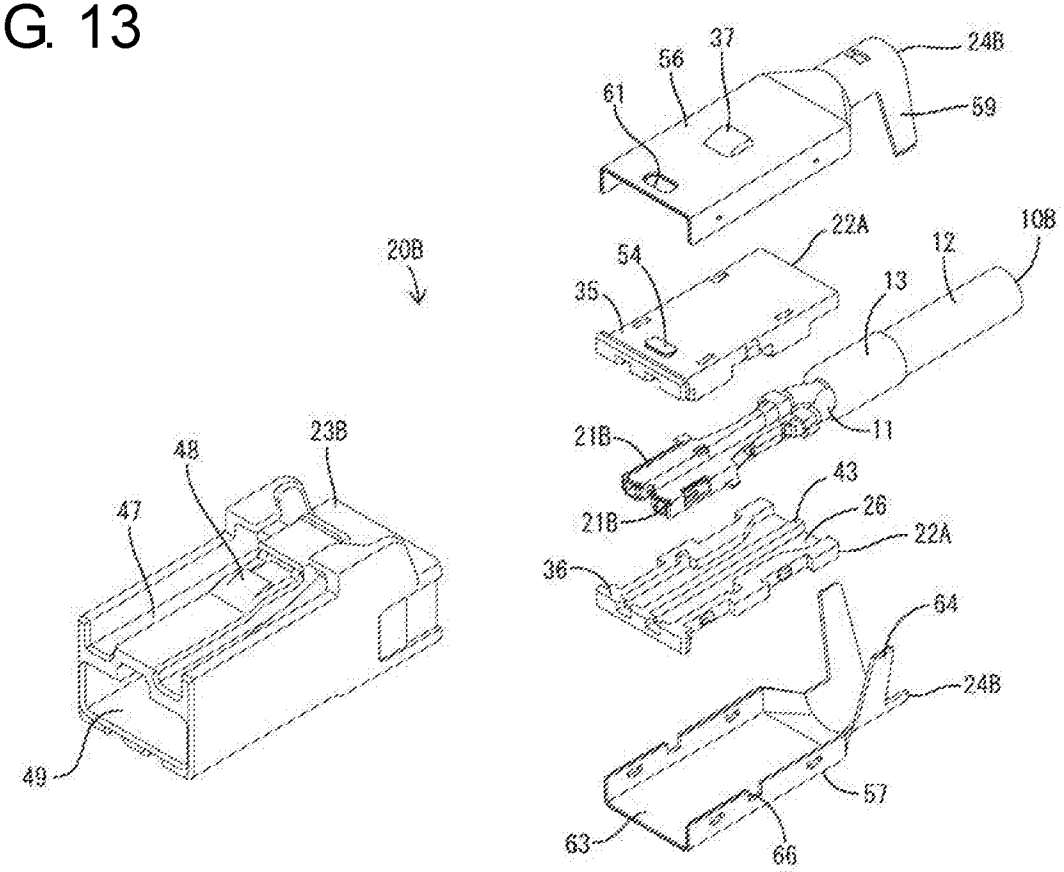
FIG. 13 is an exploded perspective view of an STP connector.
Figure 22:
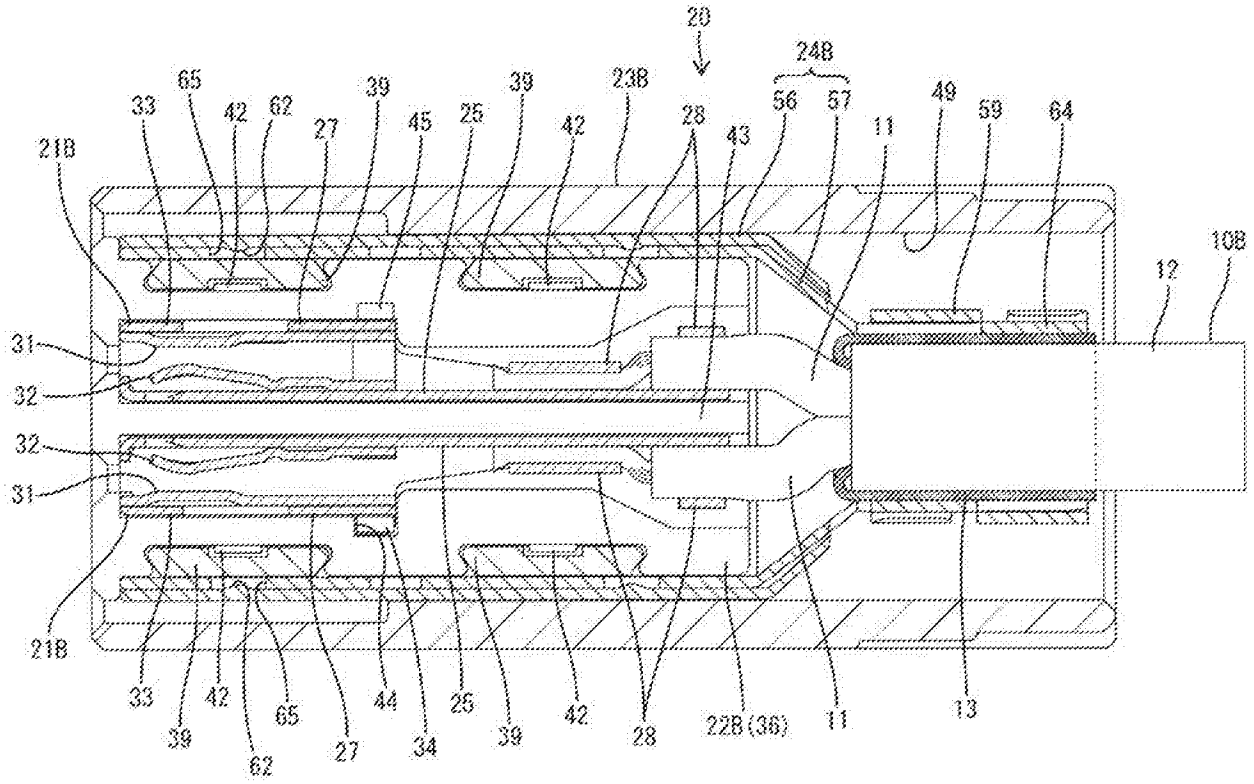
FIG. 22 is a section of the STP dielectric, the STP connection terminals and an outer conductor accommodated in the STP housing.

One embodiment of the invention is described on the basis of the drawings. A connector structure of this embodiment is used in an in-vehicle communication network system and composed of a UTP connector 20A provided on an end part of a UTP cable 10A, as shown in FIGS. 1 and 6 and an STP connector 20B provided on an end part of an STP cable 10B, as shown in FIGS. 13 and 22. The UTP connector 20A and the STP connector 20B have structural parts common or approximate to each other, and the UTP cable 10A and the STP cable 10B easily can be easily by each other while impedance is adjusted.

Figure 9:
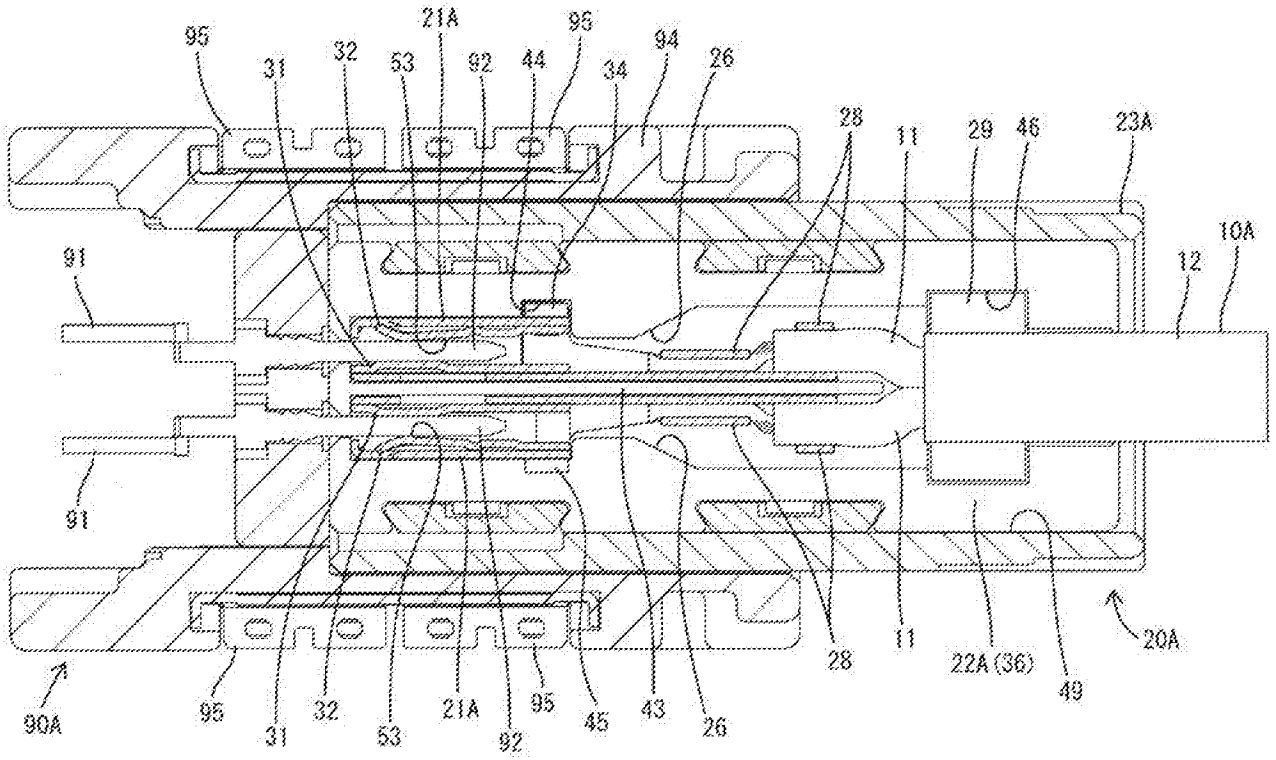
FIG. 9 is a section showing a state where the UTP connector and the mating UTP connector are connected to each other.
Figure 25:
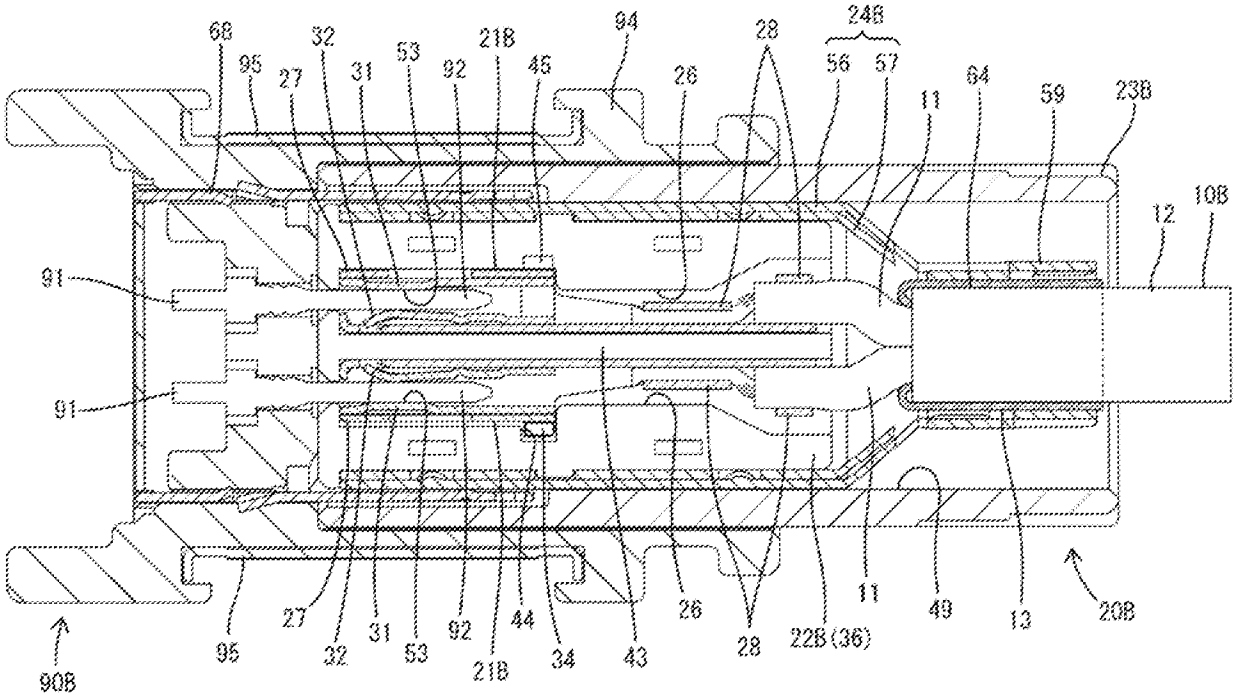
FIG. 25 is a section showing a state where the STP connector and the mating STP connector are connected to each other.

As shown in FIG. 9, the UTP connector 20A is connected to a mating UTP connector 90A and includes UTP connection terminals 21A, a UTP dielectric 22A and a UTP housing 23A. As shown in FIG. 25, the STP connector 20B is connected to a mating STP connector 90B and includes STP connection terminals 21B, an STP dielectric 22B, an outer conductor 24B and an STP housing 23B. Note that words "UTP" and "STP" in the terms of the above respective members are merely added for convenience to distinguish these.

[UTP Cable]

The UTP cable 10A is composed of a pair of twisted wires 11 and a sheath 12 surrounding the respective wires 11. The wire 11 is composed of a conductor part and a coating part surrounding the conductor part. An end part of each wire 11 is exposed from the sheath 12 and connected to the UTP connection terminal 21A.

[UTP Connection Terminal]

Figure 2:
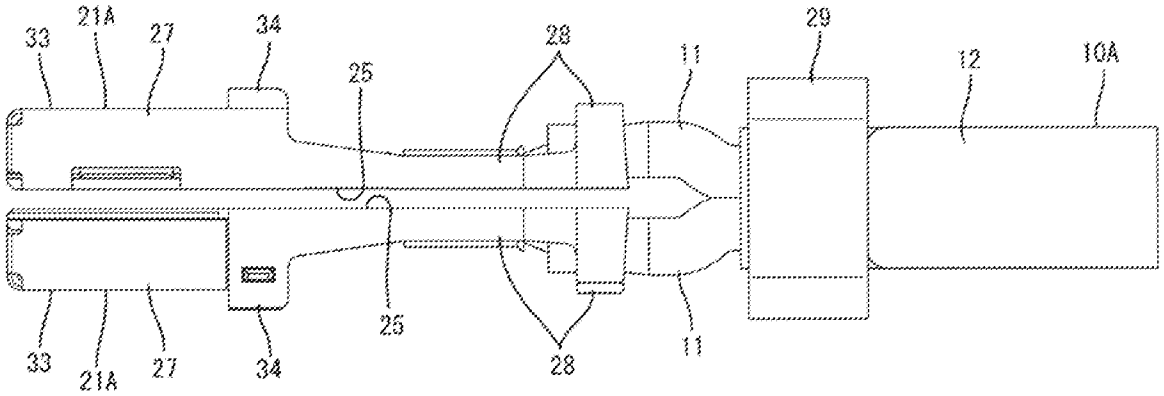
FIG. 2 is a plan view of UTP connection terminals connected to wires of a UTP cable.

The UTP connection terminals 21A to be connected to the respective wires 11 of the UTP cable 10A have the same shape. As shown in FIG. 9, the UTP connection terminal 21A is connected to a male terminal 91 provided in the mating UTP connector 90A when the UTP connector 20A and the mating UTP connector 90A are connected. As shown in FIGS. 2 and 6, the UTP connection terminal 21A is formed integrally, such as by bending a conductive metal plate material and is shaped to be long and narrow in a front-rear direction (lateral direction of FIG. 2).

Specifically, the UTP connection terminal 21A includes a base plate 25 in the form of a strip extending along the front-rear direction. As shown in FIG. 6, when the UTP connection terminals 21A are accommodated into later-described accommodating portions 26 of the UTP dielectric 22A, the base plates 25 of the respective UTP connection terminals 21A are arranged on widthwise inner sides close to each other. A box 27 substantially in the form of a rectangular tube is provided on a front end part of the base plate 25, and an open barrel 28 is provided on a rear end part of the base plate 25. The barrel 28 is connected electrically and mechanically to the conductor part and the coating part of the wire 11. Note that a crimp ring 29 separate from the UTP connection terminals 21A is crimped and connected to an end part of the sheath 12 of the UTP cable 10A. The crimp ring 29 includes parts protruding while being held in close contact on both widthwise sides by crimping.

As shown in FIG. 6, a receiving portion 31 and a resilient contact piece 32 project to face each other in a width direction (direction perpendicular to an inserting direction of the male terminal 91 into the box 27, vertical direction of FIG. 6) inside the box portion 27. The receiving portion 31 is fixed to the base plate 25 and has a trapezoidal cross-section. On the other hand, the resilient contact piece 32 is provided on a ceiling plate 33 on a side opposite to the base plate 25 and is cantilevered forward. A projecting amount (in the vertical direction of FIG. 6) of the resilient contact piece 32 into the box 27 is larger than that of the receiving portion 31. As shown in FIG. 9, when the UTP connection terminal 21A is connected to the male terminal 91, a later-described tab 92 of the male terminal 91 is inserted into the box 27 and the inserted tab 92 is sandwiched resiliently between the receiving portion 31 and the resilient contact piece 32. As just described, an insertion area 53 for the male terminal 91 is defined between the receiving portion 31 and the resilient contact piece 32 in the box 27. Further, the UTP connection terminal 21A includes a protrusion 34 projecting out (outward in the width direction in a state accommodated in the accommodating portion 26) from one end side of the ceiling plate 33.

[UTP Dielectric]

Figure 4:
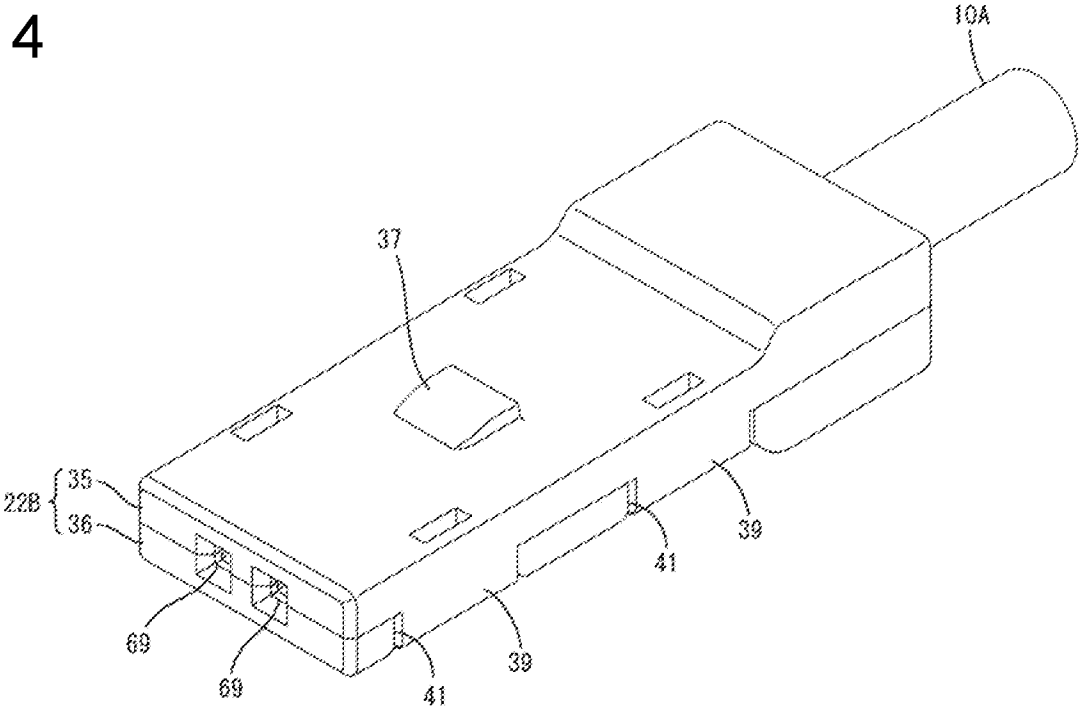
FIG. 4 is a perspective view showing a state where the UTP connection terminals are covered by an upper dielectric of the UTP dielectric.
Figure 5:
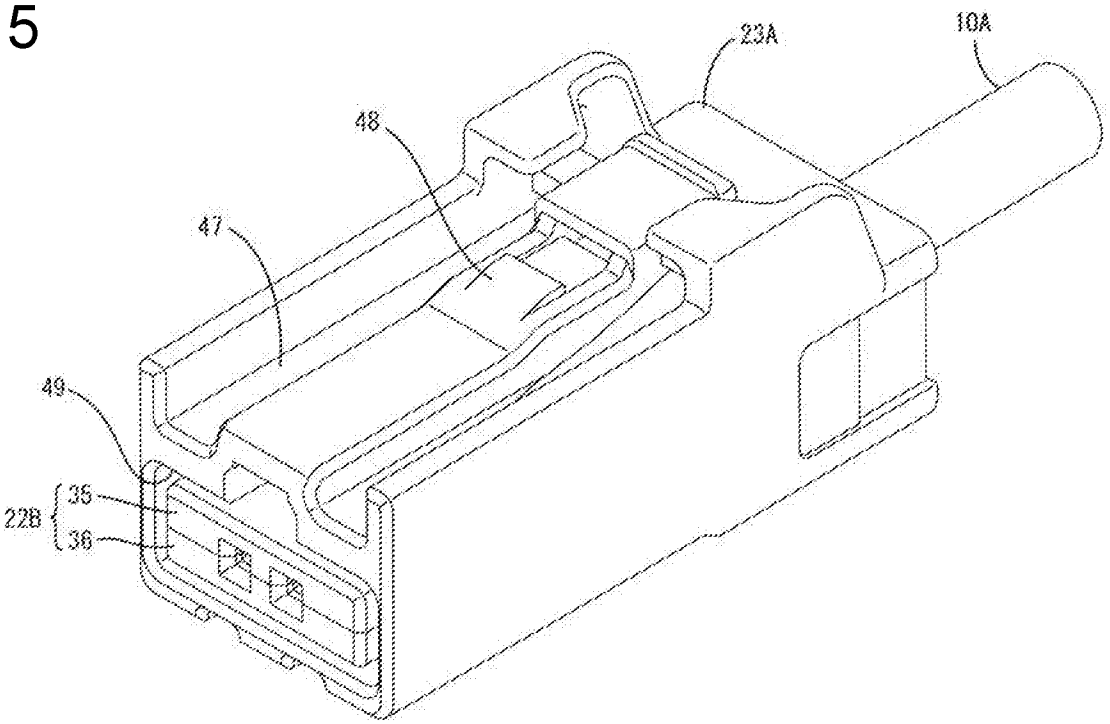
FIG. 5 is a perspective view showing a state where the UTP dielectric is accommodated in a UTP housing.

The UTP dielectric 22A is made of synthetic resin and, as shown in FIGS. 1 and 4, is composed of an upper dielectric 35 and a lower dielectric 36 that are vertically dividable. The upper dielectric 35 is in the form of a plate substantially rectangular in a plan view and includes a lock projection 37 in a widthwise central part of an upper surface. The lock projection 37 is lockable to the UTP housing 23A. Recesses 38 (see FIG. 7) are provided in the lower surface of the upper dielectric 35 for positioning upper parts of the respective UTP connection terminals 21A in parallel and for positioning an upper part of the crimp ring 29. Front and rear mounting pieces 39 project down on each of the widthwise end parts of the upper dielectric 35.

The lower dielectric 36 is in the form of a plate substantially rectangular in a plan view and includes front and rear mounting receiving portions 41 in the form of rectangular recesses on each widthwise end part and mounting projections 42 on the back surfaces of the mounting receiving portions 41. The mounting pieces 39 are fit into the respective mounting receiving portions 41 and tips of the mounting pieces 39 are hooked to lock the mounting projections 42. Thus, the lower dielectric 36 and the upper dielectric 35 are held united across the UTP connection terminals 21A.

The accommodating portions 26 extend parallel to one another in the upper surface of the lower dielectric 36 at positions facing the recesses 38 of the upper dielectric 35 and function to position and hold lower parts of the respective UTP connection terminals 21A. Each accommodating portion 26 has a cross-sectional shape corresponding to the outer shape of the UTP connection terminal 21A, and two of the accommodating portions 26 are provided on both widthwise sides across a thin separation wall 43 to correspond to the respective UTP connection terminals 21A. The base plate 25 of each UTP connection terminal 21A is arranged along a wall surface of the separation wall 43. Further, tab insertion holes 69 are open in the front surface of the UTP dielectric 22A when the upper and lower dielectrics 35, 36 are united. The tab insertion holes 69 communicate with the accommodating portions 26 and the recesses 38, and the tabs 92 are inserted therein.

The upper accommodating portion 26 in FIG. 6 includes a rectangular recess 44 in a widthwise outer side surface, and the other accommodating portion 26 includes a projecting piece 45 in the form of a plate projecting up from a widthwise outer side edge. The protrusion 34 of the UTP connection terminal 21A accommodated in the one accommodating portion 26 is fit in a positioned state in the recess 44 (see FIG. 6), and the protrusion 34 of the UTP connection terminal 21A accommodated in the other accommodating portion 26 is placed and supported on the projecting piece 45 (see FIG. 3). The protrusion 34 of the UTP connection terminal 21A accommodated in the one accommodating portion 26 is inserted deeply into the recess 44 to be arranged on a lower side, and the protrusion 34 of the UTP connection terminal 21A accommodated in the other accommodating portion 26 is arranged on an upper side to be supported on the projecting piece 45. Further, a recessed portion 46 is provided in the lower surface of the lower dielectric 36 and is continuous rearward from the accommodating portions 26 for positioning and holding a lower part of the crimp ring 29.

[UTP Housing]

Figure 7:
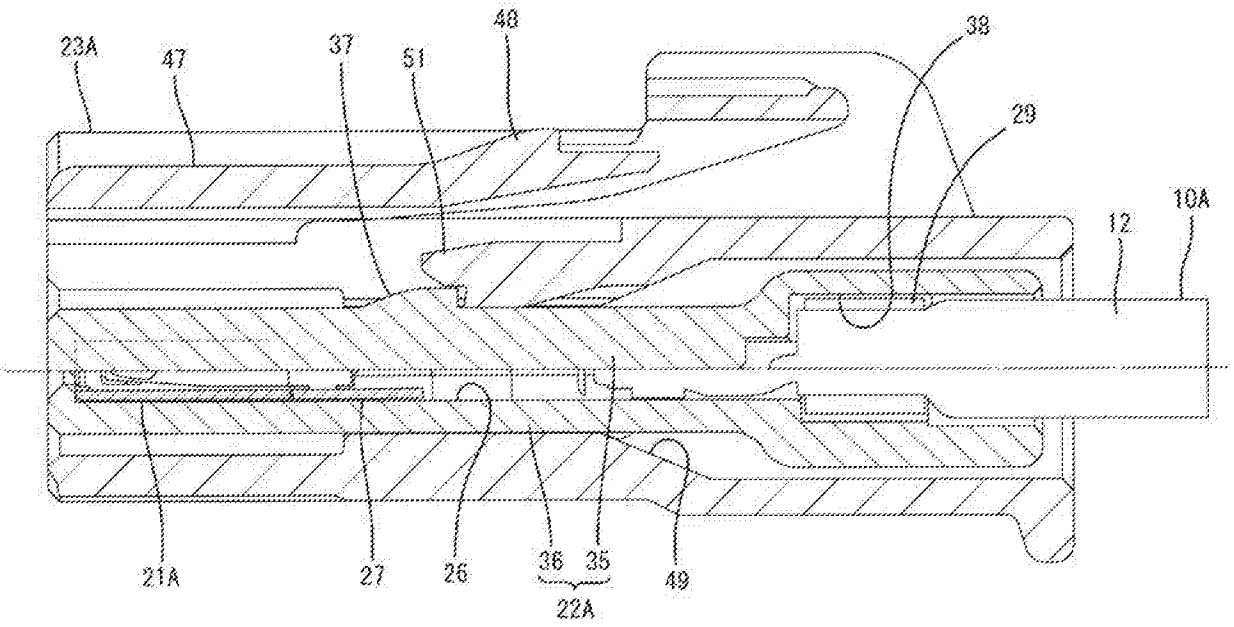
FIG. 7 is a section showing a locking structure of the UTP dielectric accommodated in the UTP housing.

The UTP housing 23A is made of synthetic resin and includes a housing body 47 substantially in the form of a rectangular tube. A lock arm 48 projects in a widthwise central part of the upper surface of the housing body 47. The lock arm 48 is cantilevered rearward from a front part of the upper surface of the housing body 47, and holds the UTP connector 20A and the mating UTP connector 90A in a connected state by resiliently locking a lock receiving portion 93 of the mating UTP connector 90A. The inside of the housing body 47 is open in the front-rear direction as an insertion portion 49. The insertion portion 49 has a cross-sectional shape corresponding to the outer shape of the UTP dielectric 22A, and the UTP dielectric 22A can fit therein. As shown in FIG. 7, a deflectable and deformable locking lance 51 is cantilevered forward from the upper surface of the inner wall of the insertion portion 49. The UTP dielectric 22A is inserted into the insertion portion 49 from behind, and the locking lance 51 returns to lock the lock projection 37 after being deflected and deformed by the lock projection 37. Thus, the UTP dielectric 22A is held in the UTP housing 23A.

[Mating UTP Connector]

The mating UTP connector 90A includes a receptacle 94 made of synthetic resin. The receptacle 94 is supported on an unillustrated circuit board and the UTP housing 23A can fit therein. The lock receiving portion 93 to be locked by the lock arm 48 projects on the inner surface of the upper wall of the receptacle 94.

As shown in FIG. 9, pegs 95 made of a metal plate material are mounted on the outer surfaces of both side walls of the receptacle 94. The pegs 95 are soldered to a surface of the circuit board so that the mating UTP connector 90A is fixed to the circuit board via the pegs 95.

Two of the male terminals 91 are mounted in the width direction. Each male terminal 91 is in the form of a rectangular wire (rectangular pin) and includes a bent part at an intermediate position in a length direction. Each male terminal 91 includes the tab 92 projecting into the receptacle 94. The tabs 92 of the respective male terminals 91 have a flat cross-sectional shape in the width direction (see FIG. 10) and are arranged in parallel while having a separation distance in the width direction corresponding to that between the respective UTP connection terminals 21A. Further, the male terminal 91 includes a part projecting out, and this part is mounted on, soldered and connected to the surface of the unillustrated circuit board.

[STP Cable]

The STP cable 10B is composed of a pair of twisted wires 11, a shield conductor 13 such as a braided wire surrounding and shielding the respective wires 11, and a sheath 12 surrounding the shield conductor 13. An end part of each wire 11 and an end part of the shield conductor 13 are exposed from the sheath 12. The end part of the shield conductor 13 is folded and put on an outer peripheral side of the sheath 12. The end part of each wire 11 is connected to the STP connection terminal 21B.

[STP Connection Terminal]

The STP connection terminals 21B to be connected to the respective wires 11 of the STP cable 10B have the same shape. As shown in FIG. 25, the STP connection terminal 21B is connected to a male terminal 91 provided in the mating STP connector 90B when the STP connector 20B and the mating STP connector 90B are connected. The STP connection terminal 21B is formed integrally such as by bending a conductive metal plate material and is shaped to be long and narrow in the front-rear direction.

Figure 16:
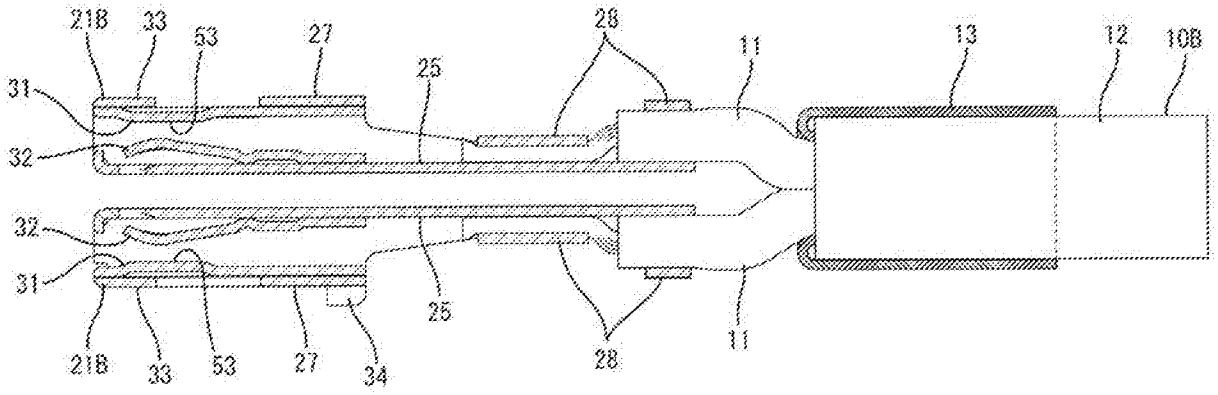
FIG. 16 is a section of STP connection terminals connected to an STP cable.

This STP connection terminal 21B has substantially the same configuration as the UTP connection terminal 21A and includes a base plate 25, a box 27 and a barrel 28. The box 27 and the barrel 28 of the STP connection terminal 21B have substantially the same shapes as the box 27 and the barrel 28 of the UTP connection terminal 21A. Of course, the arrangement of a receiving portion 31 and a resilient contact piece 32 with respect to the box 27 of the STP connection terminal 21B is opposite to that of the UTP connection terminal 21A. Specifically, as shown in FIG. 16, the receiving portion 31 of the STP connection terminal 21B is provided on a ceiling plate 33 and the resilient contact piece 32 of the STP connection terminal 21B is provided on the base plate 25. Thus, the insertion area 53 for the male terminal 91 in the box 27 is deviated toward the base plate 25 in the UTP connection terminal 21A, but an insertion area 53 is deviated toward the ceiling plate 33 in the STP connection terminal 21B. Further, similar to the UTP connection terminal 21A, the STP connection terminal 21B includes a protrusion 34 projecting out from one end side of the ceiling plate 33.

[STP Dielectric]

Figure 18:
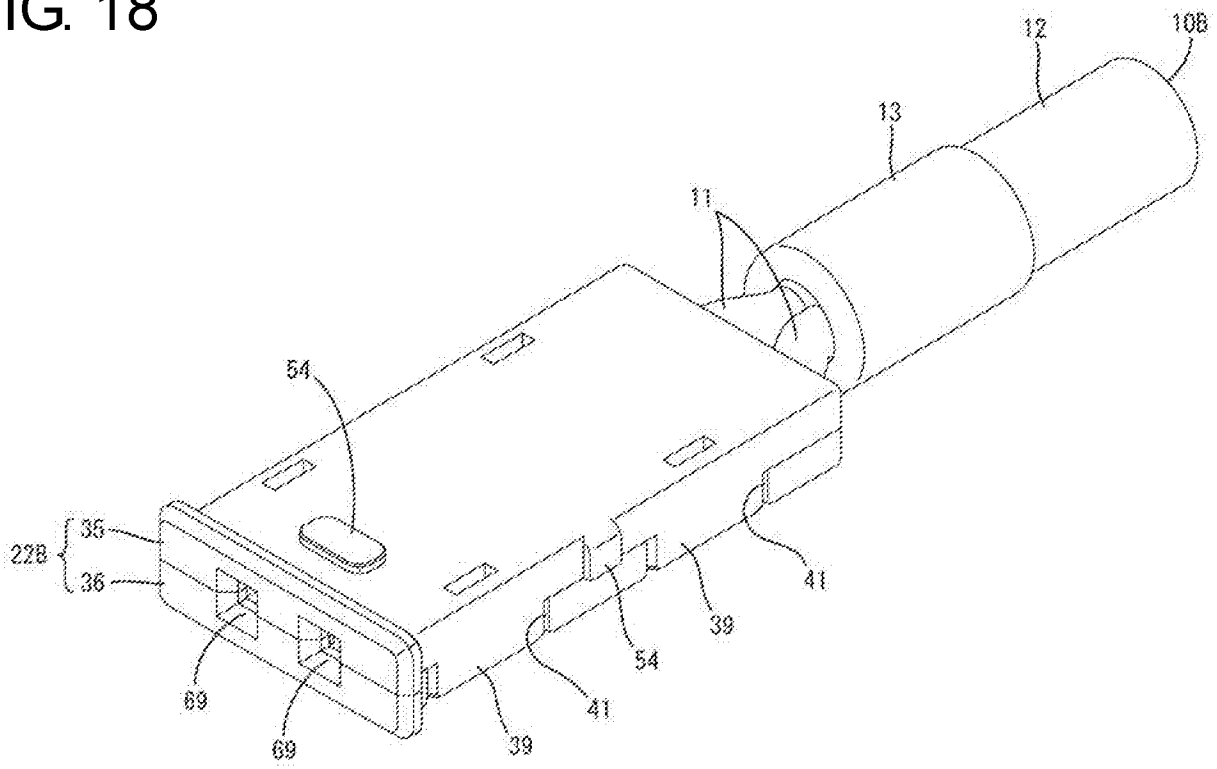
FIG. 18 is a perspective view showing a state where the STP connection terminals are covered by an upper dielectric of the STP dielectric.

The STP dielectric 22B is made of synthetic resin and, as shown in FIGS. 13 and 18, is composed of an upper dielectric 35 and a lower dielectric 36 that are vertically dividable. The upper dielectric 35 is a substantially rectangular plate and includes positioning protrusions 54 for the outer conductor 24B on an upper surface and both side surfaces. Similar to the upper dielectric 35 of the UTP dielectric 22A, mounting pieces 39 are provided on both widthwise end parts of the upper dielectric 35. The lower dielectric 36 also is provided with mounting receiving portions 41 and mounting projections 42 similar to the lower dielectric 36 of the UTP dielectric 22A, and the lower and upper dielectrics 36, 35 are held united across the STP connection terminals 21B by the locking of the mounting pieces 9 and the mounting projections 42.

The STP connector 20B has no crimp ring 29 and a part (part corresponding to the recessed part 46) for receiving the crimp ring 29 is not necessary in rear parts of the upper and lower dielectrics 35, 36. Thus, a dimension of the STP dielectric 22B in the front-rear direction is shorter than that of the UTP dielectric 22A by that much.

Figure 23:
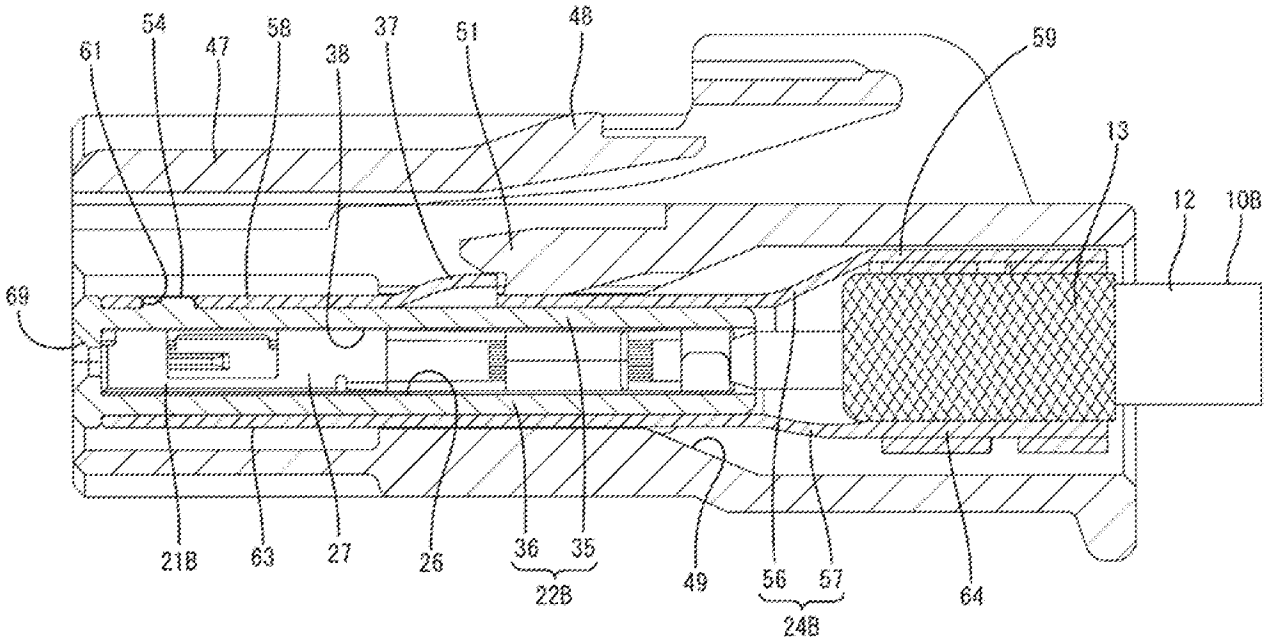
FIG. 23 is a section showing a locking structure of the outer conductor accommodated in the STP housing.

As shown in FIG. 23, recesses 38 for positioning upper parts of the respective STP connection terminals 21B in parallel are provided in the lower surface of the upper dielectric 35, and accommodating portions 26 for positioning and holding the lower parts of the respective STP connection terminals 21B in parallel are provided at positions facing the recesses 38 in the upper surface of the lower dielectric 36.

The accommodating portion 26 has a cross-sectional shape corresponding to the outer shape of the STP connection terminal 21B, and two of the accommodating portions 26 are provided on both widthwise sides across a separation wall 43 to correspond to the respective STP connection terminals 21B. As shown in FIG. 25, the base plates 25 of the respective STP connection terminals 21B are arranged along wall surfaces of the separation wall 43 and the STP connection terminals 21B are arranged back-to-back in the accommodating portions 26 paired in the width direction. This point also applies to the respective UTP connection terminals 21A. A thickness (dimension in the width direction) of the separation wall 43 of the STP dielectric 22B is larger than that of the separation wall 43 of the UTP dielectric 22A. That is, a separation distance in the width direction of the respective accommodating portions 26 of the STP dielectric 22B is greater than that of the respective accommodating portions 26 of the UTP dielectric 22A. As shown in FIG. 18, tab insertion holes 69 are open in the front surface of the STP dielectric 22B when the upper and lower dielectrics 35, 36 are united. The tab insertion holes 69 communicate with the accommodating portions 26 and the recesses 38 and receive the tabs 92.

An upper one of the respective accommodating portions 26 in FIG. 22 includes a projecting piece 45 in the form of a plate projecting up from a widthwise outer side edge, and the other accommodating portion 26 includes a rectangular recess 44 in a widthwise outer side edge. The protrusion 34 of the STP connection terminal 21B accommodated in the one accommodating portion 26 is placed and supported on the projecting piece 45, and the protrusion 34 of the STP connection terminal 21B accommodated in the other accommodating portion 26 is fit and inserted in the recess 44. Contrary to the UTP connection terminal 21A, the STP connection terminal 21B accommodated in the one accommodating portion 26 is arranged on an upper side to be supported on the projecting piece 45, and the STP connection terminal 21B accommodated in the other accommodating portion 26 is inserted deeply into the recess 44 to be arranged on a lower side.

[Outer Conductor]

Figure 15:
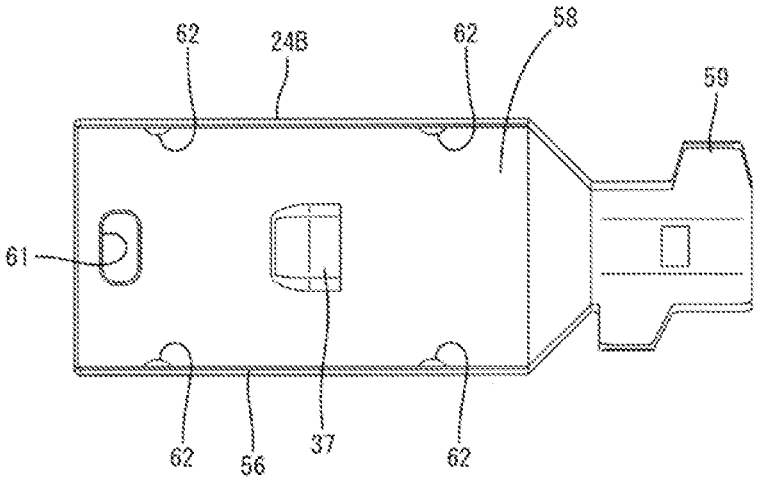
FIG. 15 is a bottom view of an upper outer conductor.
Figure 20:
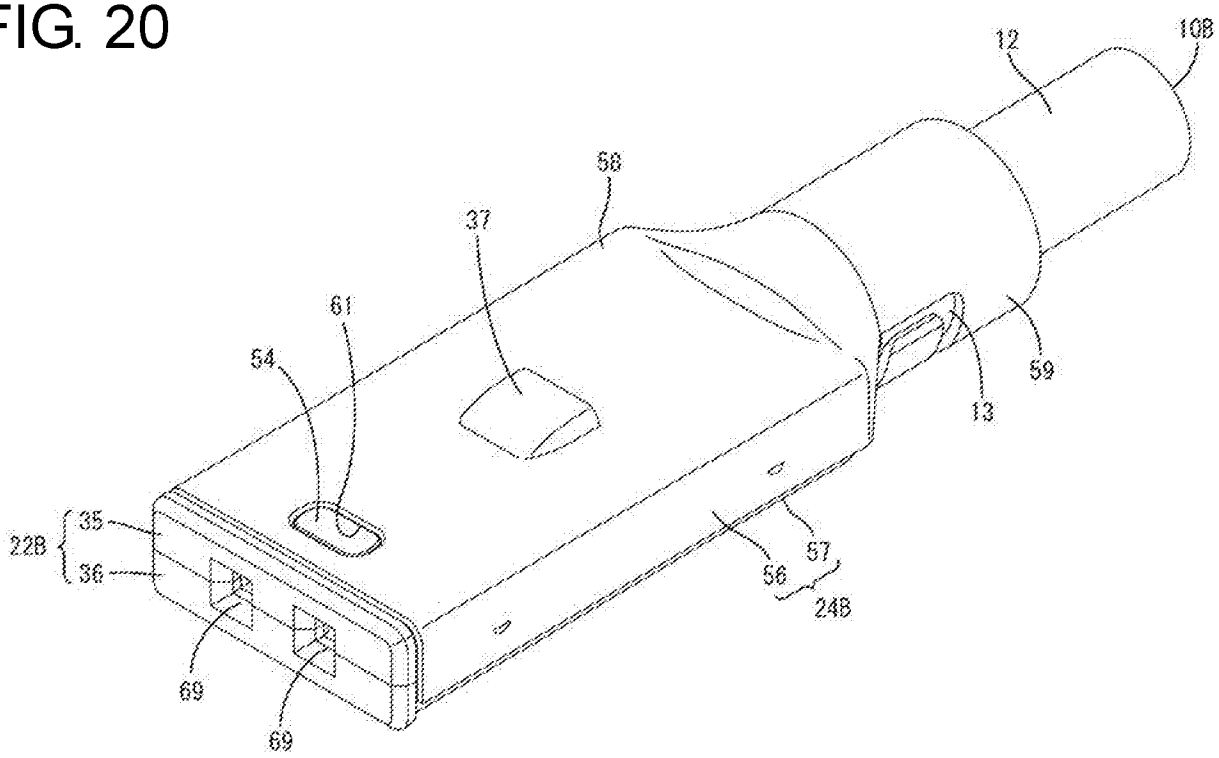
FIG. 20 is a perspective view showing a state where the upper outer conductor covers an upper part of the STP dielectric.
Figure 21:
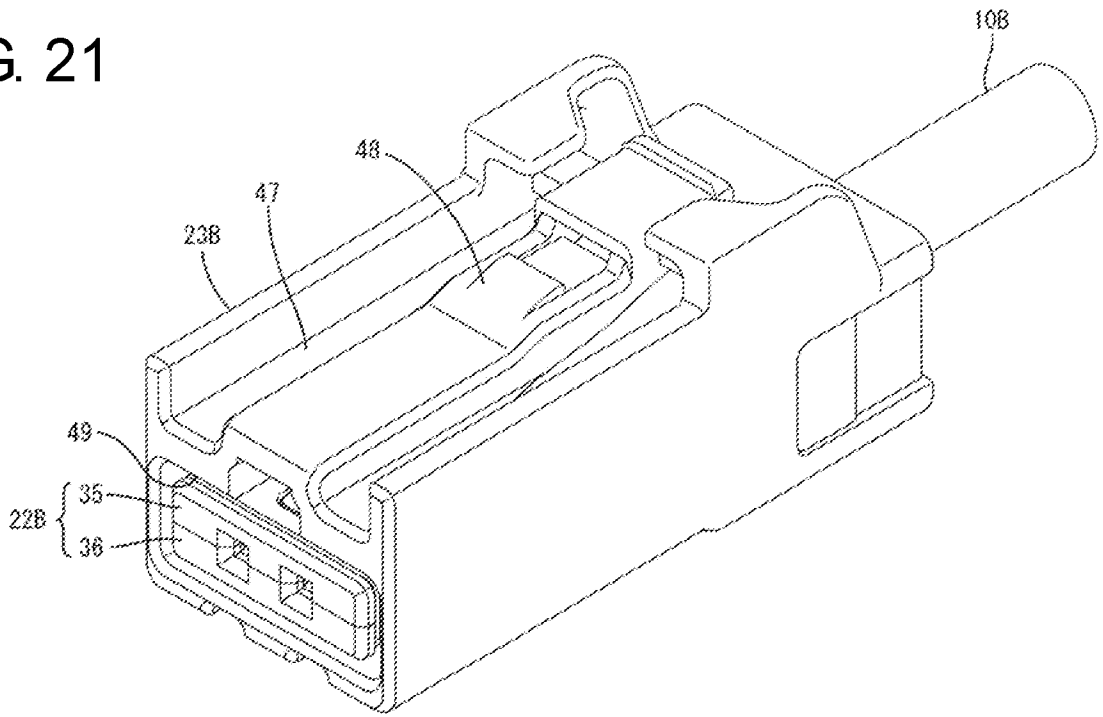
FIG. 21 is a perspective view showing a state where the STP dielectric is accommodated in an STP housing.

The outer conductor 24B is made of conductive metal and, as shown in FIGS. 13 and 20, is composed of an upper outer conductor 56 and a lower outer conductor 57 that are vertically dividable. As shown in FIG. 15, the upper outer conductor 56 includes an upper shell 58 substantially rectangular in a plan view and an upper barrel 59 in the form of an open barrel connected to and behind the upper shell 58. The upper shell 58 is arranged to cover the upper dielectric 35 from above. A flat plate part of the upper shell 58 includes a lock projection 37 in a widthwise central part of an upper surface and an upper positioning hole 61 in front of the lock projection 37. Further, the upper shell 58 includes side plates hanging down from both widthwise ends of the flat plate, and front and rear holding projections 62 on the inner surface of each of the side plates. The upper barrel 59 includes a projecting piece displaced in the front-rear direction from both widthwise side edges and projecting down.

Figure 14:
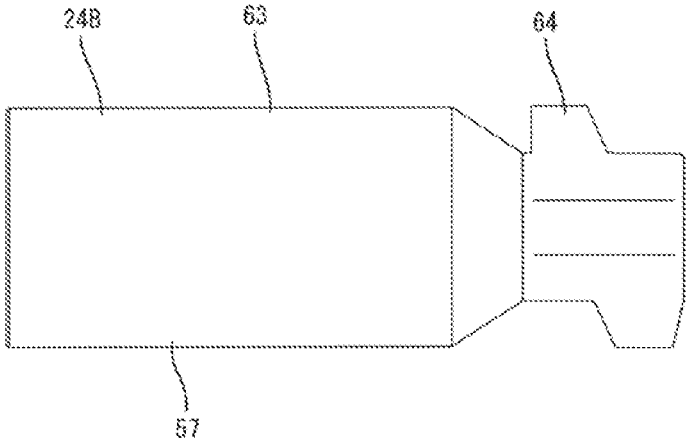
FIG. 14 is a bottom view of a lower outer conductor.
Figure 19:
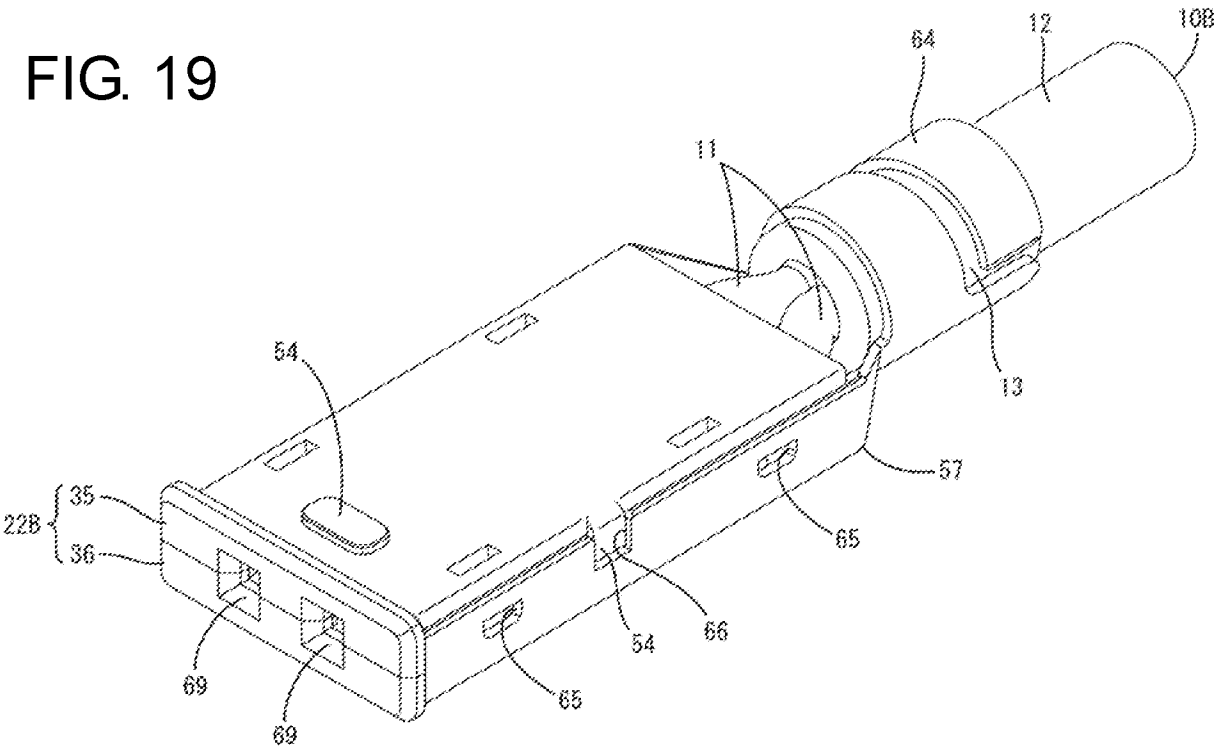
FIG. 19 is a perspective view showing a state where the lower outer conductor covers a lower part of the STP dielectric.

As shown in FIG. 14, the lower outer conductor 57 includes a lower shell 63 that is substantially rectangular in a plan view and a lower barrel 64 in the form of an open barrel connected to and behind the lower shell 63. As shown in FIG. 19, the lower shell 63 is arranged to cover the lower dielectric 36 from below. The lower shell 63 includes side plates rising from both widthwise ends of a flat plate and front and rear holding holes 65 in each of the side plates. Further, lower positioning holes 66 are open in the upper ends of central parts of the side plate parts of the lower shell 63 in the front-rear direction. The lower barrel 64 includes a projecting piece displaced in the front-rear direction from both widthwise end edges and projecting up.

When the upper and lower outer conductors 56, 57 are united while enclosing the STP dielectric 22B, the side plates of the upper shell 58 cover those of the lower shell portion 63 from outside and, as shown in FIG. 22, the respective holding projections 62 are inserted and locked into the holding holes 65. Further, a pair of front and rear projecting pieces of each of the upper and lower barrels 59, 64 are arranged.

[STP Housing]

The STP housing 23B is made of synthetic resin and includes a housing body 47 substantially in the form of a rectangular tube. The STP housing 23B has substantially the same shape as the UTP housing 23A and includes a lock arm 48, an insertion portion 49 and a locking lance 51 having the same forms (shapes and arrangement) of those of the UTP housing 23A. Of course, as shown in FIG. 23, a locking partner of the locking lance 51 is not the STP dielectric 22B, but the upper outer conductor 56.

[Mating STP Connector]

Figure 8:
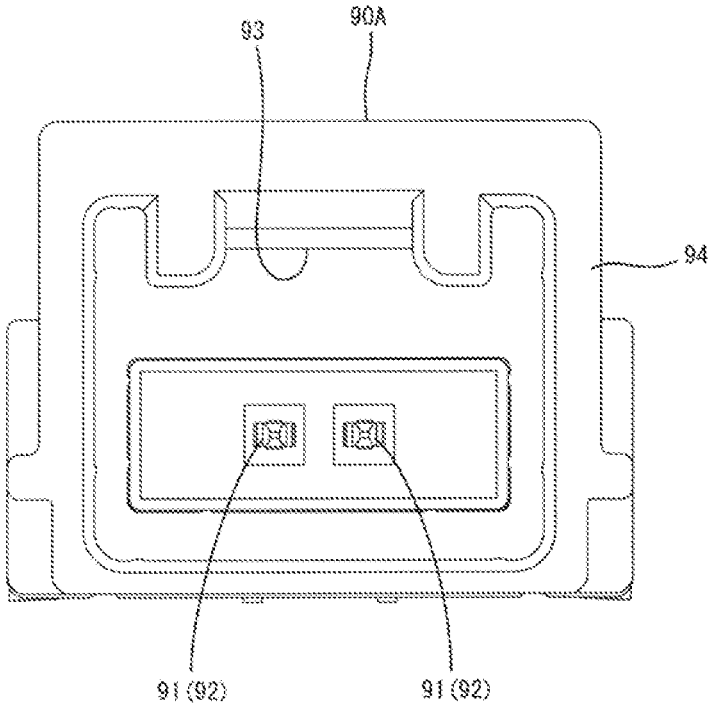
FIG. 8 is a front view of a mating UTP connector.
Figure 24:
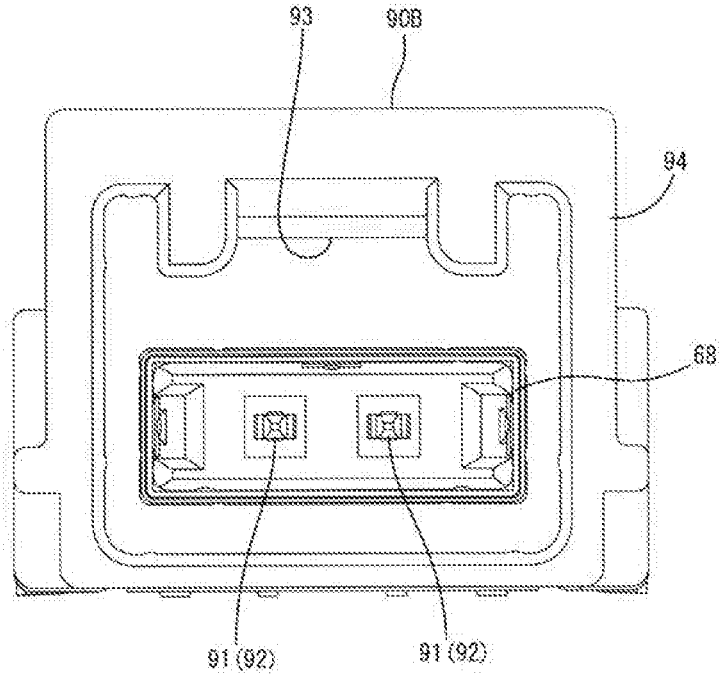
FIG. 24 is a front view of a mating STP connector.

The mating STP connector 90B includes a receptacle 94 made of synthetic resin. The mating STP connector 90B has substantially the same configuration as the mating UTP connector 90A and includes the receptacle 94, a lock receiving portion 93, pegs 95 and two male terminals 91. Of course, a separation distance in the width direction of the respective male terminals 91 of the mating STP connector 90B is longer than that of the male terminals 91 of the mating UTP connector 90A (see FIGS. 8 and 24).

[Assembling of UTP Connector]

Figure 3:
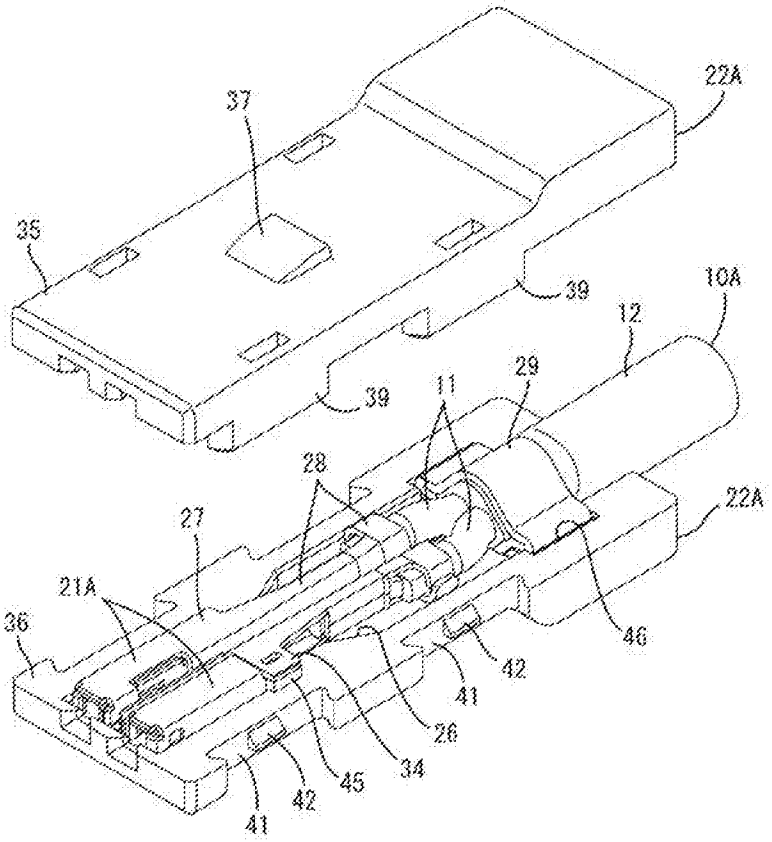
FIG. 3 is a perspective view showing a state where the UTP connection terminals are accommodated in accommodating portions of a UTP dielectric.

In assembling the UTP connector 20A, the barrels 28 of the UTP connection terminals 21A first are connected to the end parts of the respective wires 11 of the UTP cable 10A by crimping, as shown in FIG. 2. Subsequently, as shown in FIG. 3, the respective UTP connection terminals 21A are positioned and inserted into the accommodating portions 26 of the lower dielectric 36 from above, and the crimp ring 29 fit to the UTP cable 10A is positioned and inserted into the recessed portion 46 of the lower dielectric 36. Subsequently, as shown in FIG. 4, the upper dielectric 35 is put on the lower dielectric 36 from above. The mounting pieces 39 resiliently lock the mounting projections 42 so that the upper and lower dielectrics 35, 36 (UTP dielectric 22A) are held united. The respective UTP connection terminals 21A are arranged in the UTP dielectric 22A with the base plates 25 thereof held close to each other via the separation wall 43 in the width direction, and the insertion areas 53 for the male terminals 91 in the boxes 27 also are arranged close to each other in the width direction.

Subsequently, the UTP dielectric 22A is inserted into the insertion portion 49 of the UTP housing 23A from behind. When the UTP dielectric 22A is inserted properly into the insertion portion 49, as shown in FIG. 7, the locking lance 51 resiliently locks the lock projection 37 of the UTP dielectric 22A so that the UTP dielectric 22A is retained and held in the UTP housing 23A.

[Assembling of STP Connector]

Figure 17:
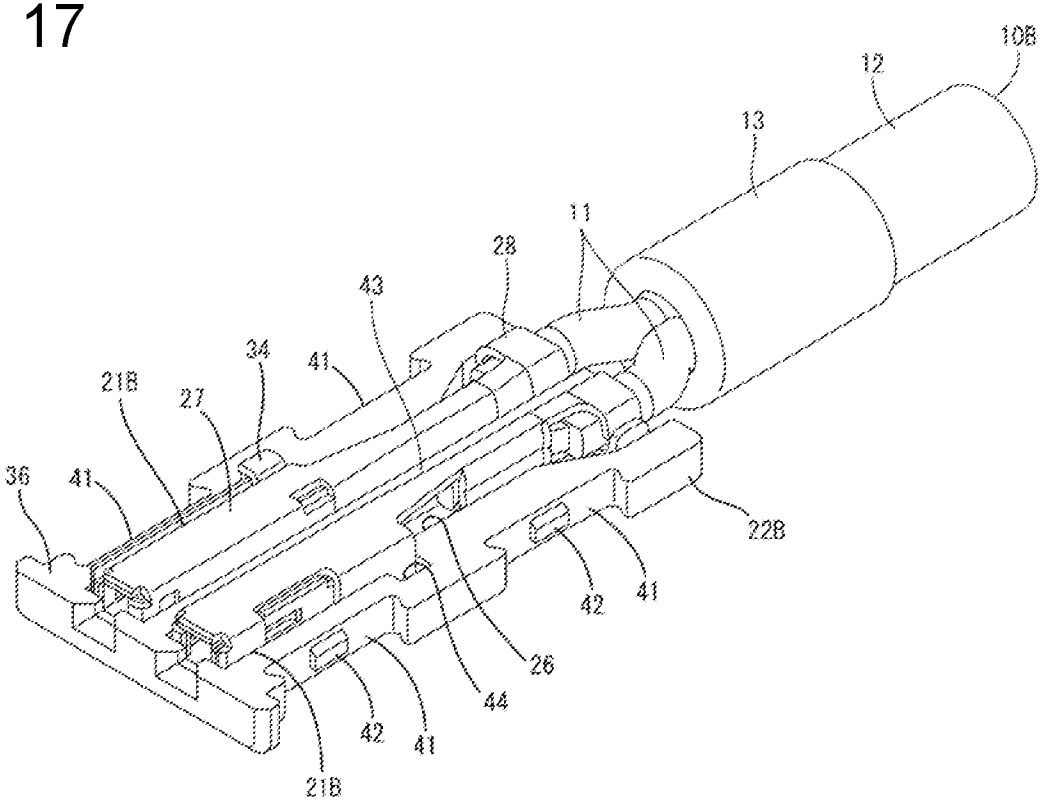
FIG. 17 is a perspective view showing a state where the STP connection terminals are accommodated in accommodating portions of an STP dielectric.

In assembling the STP connector 20B, the barrels 28 of the STP connection terminals 21B first are connected to the end parts of the respective wires 11 of the STP cable 10B by crimping, as shown in FIG. 16. Then, after the respective STP connection terminals 21B are positioned and inserted into the accommodating portions 26 of the lower dielectric 36 from above, as shown in FIG. 17, the upper dielectric 35 is put on the lower dielectric 36 from above and the upper and lower dielectrics 35, 36 are held together by the locking of the mounting pieces 39 and the mounting projections 42, as shown in FIG. 18. The respective STP connection terminals 21B are arranged in the STP dielectric 22B such that the base plates 25 thereof are farther apart in the width direction than in the case of the above UTP connector 20A via the separation wall 43, and the insertion areas 53 for the male terminals 91 in the boxes 27 also are arranged farther apart in the width direction than in the case of the UTP connector 20A.

Subsequently, as shown in FIG. 19, the STP dielectric 22B is placed on the lower shell 63 of the lower outer conductor 57. The positioning protrusions 54 disposed on the both side surfaces of the upper dielectric 35 are aligned with and fit into the lower positioning holes 66 of the lower shell 63 to position the lower outer conductor 57 with respect to the STP dielectric 22B in the front-rear direction. At this time, the lower barrel 64 faces the shield conductor 13 exposed on the outer peripheral side of the STP cable 10B from below. In that state, the lower barrel 64 is connected to the shield conductor 13 of the STP cable 10B by crimping.

Subsequently, as shown in FIG. 20, the upper outer conductor 56 is put on the lower outer conductor 57 to cover the STP dielectric 22B from above. The upper and lower outer conductors 56, 57 (outer conductor 24B) are held in a division restricted state by the locking of the holding projections 62 and the holding holes 65. Further, the positioning protrusion 54 disposed on the upper surface of the upper dielectric 35 is aligned with and fit into the upper positioning hole 61 of the upper shell 58 to position the upper outer conductor 56 with respect to the STP dielectric 22B in the front-rear direction. Then, the upper barrel 59 is arranged to face the shield conductor 13 of the STP cable 10B from above. In that state, the upper barrel 59 is connected to the shield conductor 13 of the STP cable 10B by crimping. In this way, the shield conductor 13 is connected to the outer conductor 24B and the STP connection terminals 21B are surrounded by the outer conductor 24B via the STP dielectric 22B.

Thereafter, the outer conductor 24B that is united with and enclosing the respective STP connection terminals 21B and the STP dielectric 22B is inserted into the insertion portion 49 of the STP housing 23B from behind. When the outer conductor 24B is inserted properly into the insertion portion 49, as shown in FIG. 23, the locking lance 51 resiliently locks the lock projection 37 of the outer conductor 24B to hold the outer conductor 24B in the STP housing 23B.

[Connector Connection]

When the UTP connector 20A is connected properly to the mating UTP connector 90A, the lock arm 48 resiliently locks the lock receiving portion 93 to hold the connectors 20A, 90A in a separation restricted state. At this time, as shown in FIG. 9, the tabs 92 of the respective male terminals 91 are inserted and connected into the insertion areas 53 in the boxes 27 of the respective UTP connection terminals 21A. In this way, the tabs 92 of the respective male terminals 91 are arranged close to each other in the width direction.

Similarly, when the STP connector 20B is connected properly to the mating STP connector 90B, the lock arm 48 resiliently locks the lock receiving portion 93, the connectors 20B, 90B are held in a separation restricted state and, as shown in FIG. 25, the tabs 92 of the respective male terminals 91 are inserted and connected into the insertion areas 53 in the boxes 27 of the respective STP connection terminals 21B. The tabs 92 of the respective male terminals 91 are farther apart in the width direction than in the case of the above UTP connector 20A. Further, the outer conductor 24B is connected to a ground plate 68 disposed in the receptacle 94.

Functions and Effects

Figure 10:
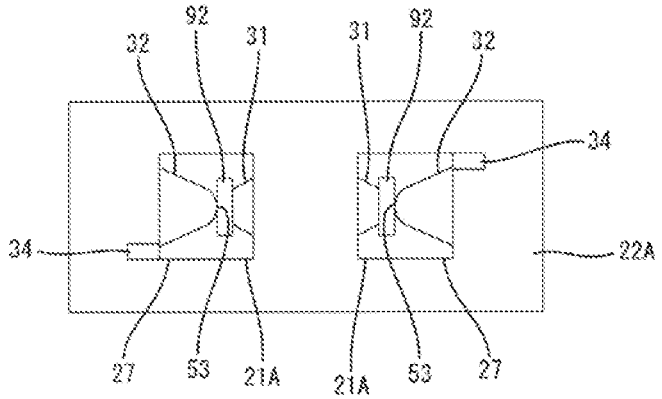
FIG. 10 is a diagram of a mode shown in FIGS. 1 to 9.
Figure 26:
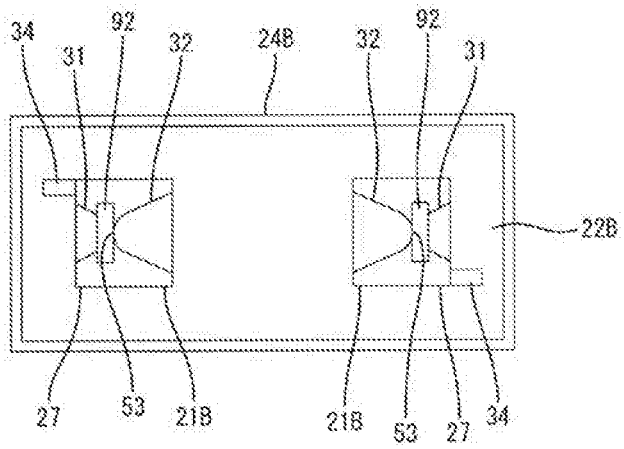
FIG. 26 is a diagram of a mode shown in FIGS. 13 to 25.

In the case of the UTP connector 20A, the impedance is smaller than in the STP connector 20B since the tabs 92 of the respective male tabs 91 are close to each other in the width direction while being accommodated in the accommodating portions 26 paired in the width direction (see FIG. 10). On the other hand, in the case of the STP connector 20B, the impedance is larger than in the UTP connector 20A since the tabs 92 of the respective male tabs 91 are arranged apart from each other in the width direction while being accommodated in the accommodating portions 26 paired in the width direction (see FIG. 26).

Further, the impedance can be reduced by arranging the respective UTP connection terminals 21A closer to each other than the respective STP connection terminals 21B with the respective UTP connection terminals 21A accommodated in the accommodating portions 26 paired in the width direction, and the impedance also can be increased by arranging the respective STP connection terminals 21B farther apart than the respective UTP connection terminals 21A with the respective STP connection terminals 21B accommodated in the accommodating portions 26 paired in the width direction.

As described above, the UTP connector 20A and the STP connector 20B have a substantially common configuration and there is no large structural difference between their configurations except that the STP connector 20B includes the outer conductor 24B. Thus, in replacing the UTP cable 10A by the STP cable 10B or replacing the STP cable 10B by the UTP cable 10A, the connector structure need not be changed significantly and cost can be reduced.

Further, the impedance is decreased by locating the resilient contact pieces 32 on the widthwise outer sides and locating the receiving portions 31 on the widthwise inner sides in the accommodating portions 26 paired in the width direction in the case of the UTP connection terminals 21A and is increased by locating the resilient contact pieces 32 on the widthwise inner sides and locating the receiving portions 31 on the widthwise outer sides in the accommodating portions 26 paired in the width direction in the case of the STP connection terminals 21B. In adjusting the impedance, it is sufficient merely to reverse a positional relationship of the resilient contact pieces 32 and the receiving portions 31 between the UTP connector 20A and the STP connector 20B. Therefore, it is not necessary to apply special processing and cost can be reduced.

Other Modes

The UTP connection terminals 21A in the mode shown in FIGS. 1 to 10 described above are accommodated in the accommodating portions 26 paired in the width direction such that the protrusions 34 are located on the widthwise outer sides. Further, the recess 44 and the projecting piece 45 for receiving the protrusions 34 are provided at widthwise outer positions in the accommodating portions 26 paired in the width direction. Similarly, the STP connection terminals 21B in the mode shown in FIGS. 13 to 26 described above are accommodated in the accommodating portions 26 paired in the width direction such that the protrusions 34 are located on the widthwise outer sides and the recess 44 and the projecting piece 45 for receiving the protrusions 34 are respectively provided at widthwise outer positions in the accommodating portions 26 paired in the width direction.

Figure 11:
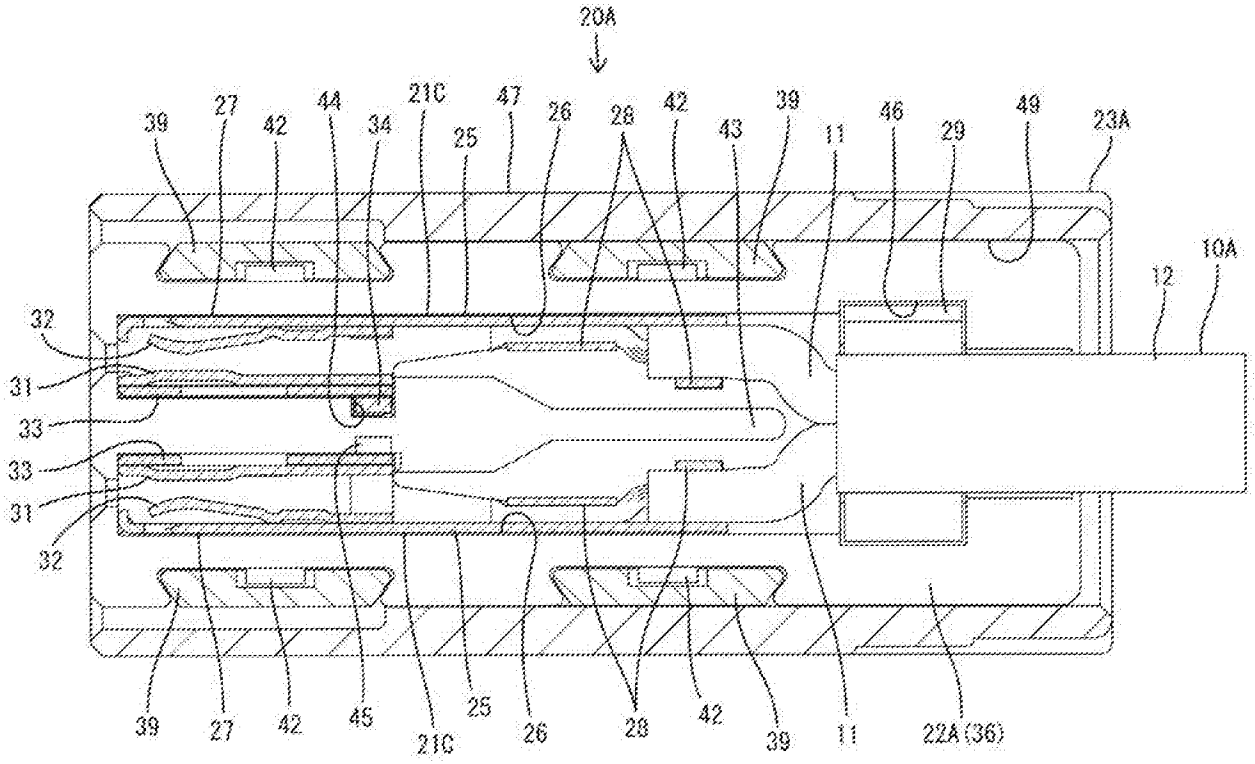
FIG. 11 is a section, corresponding to FIG. 6, of another mode in which protrusions of UTP connection terminals are arranged to face each other.
Figure 12:
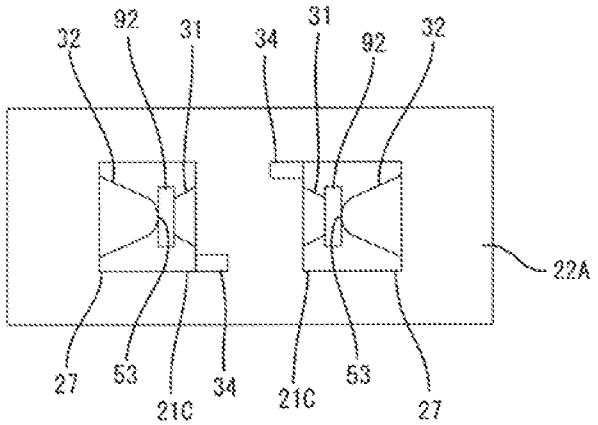
FIG. 12 is a diagram of the other mode shown in FIG. 11.
Figure 27:
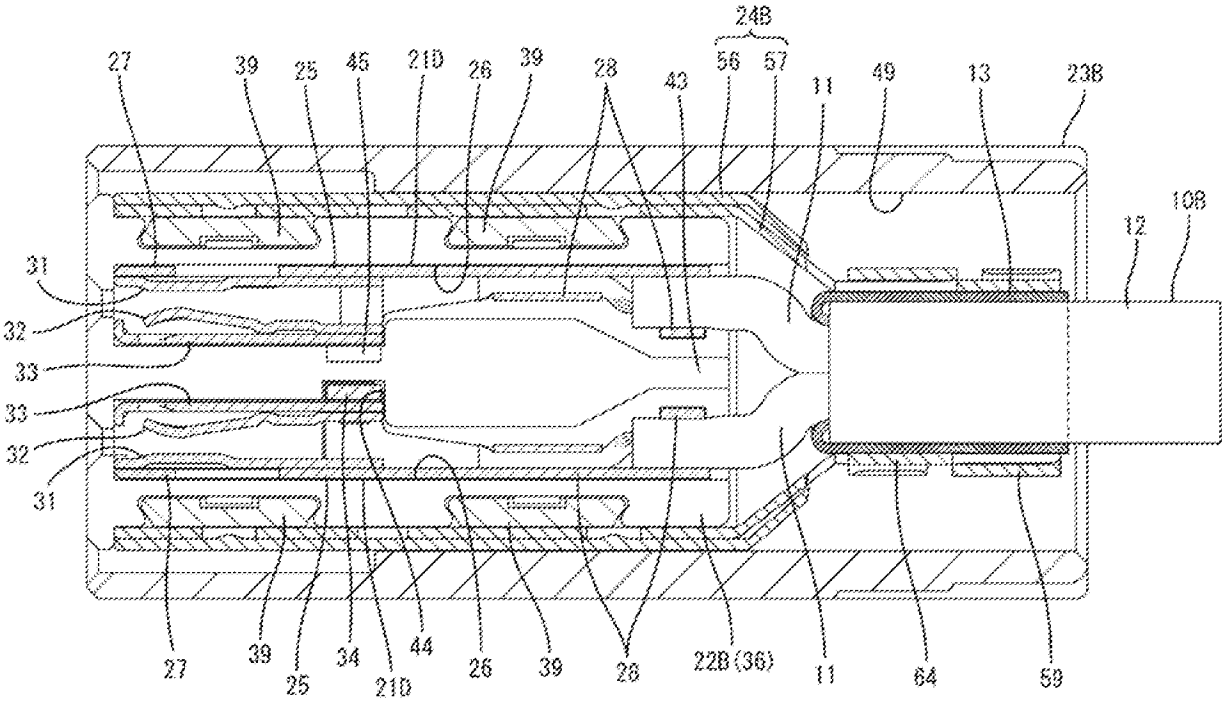
FIG. 27 is a section, corresponding to FIG. 22, of another mode in which protrusions of STP connection terminals are arranged to face each other.
Figure 28:
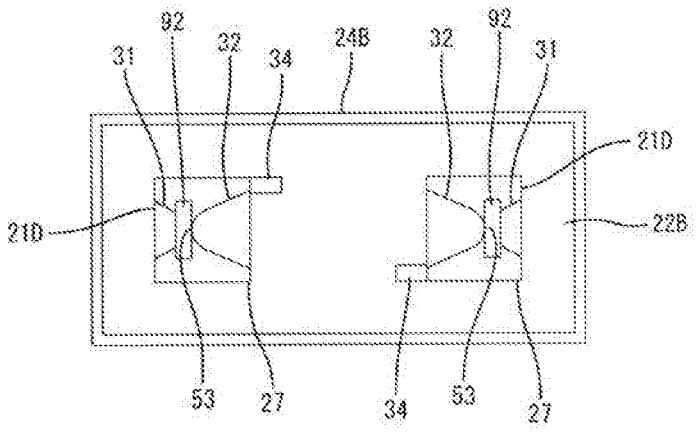
FIG. 28 is a diagram of the other mode shown in FIG. 27.

In contrast, UTP connection terminals 21C in a mode shown in FIG. 11 are accommodated in accommodating portions 26 paired in the width direction such that protrusions 34 are located on widthwise inner sides to face each other and a recess 44 and a projecting piece 45 for receiving the protrusions 34 are provided at widthwise inner positions in the accommodating portions 26 paired in the width direction. Similarly, STP connection terminals 21D in a mode shown in FIG. 27 are accommodated in accommodating portions 26 paired in the width direction such that protrusions 34 are located on the widthwise inner sides to face each other and a recess 44 and a projecting piece 45 for receiving the protrusions 34 are respectively provided at widthwise inner positions in the accommodating portions 26 paired in the width direction.

The UTP connection terminals 21C in the other mode are arranged such that insertion areas 53 for male tabs 91 in boxes 27 are closer to each other in the width direction than in the STP connection terminals 21D while being accommodated in the accommodating portions 26 paired in the width direction. The STP connection terminals 21D in the other mode are arranged such that insertion areas 53 for male tabs 91 in boxes 27 are farther from each other in the width direction than in the UTP connection terminals 21C while being accommodated in the accommodating portions 26 paired in the width direction. This point is the same as with the UTP connection terminals 21A in the mode shown in FIGS. 1 to 10 and the STP connection terminals 21B in the mode shown in FIGS. 13 to 26. Therefore, the impedance can be adjusted to an appropriate value also in the UTP connection terminals 21C and the STP connection terminals 21D in the other modes.

Other Embodiments

Other embodiments are briefly described.

Although both the UTP dielectric and the STP dielectric are vertically dividable in the above embodiment, at least one of the UTP dielectric and the STP dielectric may be unitary to be undividable according to the invention.

Although the outer conductor of the STP connector is vertically dividable in the above embodiment, the outer conductor may be unitary to be undividable according to the present invention.

Although the separation distance in the width direction of the accommodating portions of the STP dielectric is longer than that of the accommodating portions of the UTP dielectric in the above embodiment, the separation distance in the width direction of the accommodating portions of the STP dielectric may be substantially equal to that of the accommodating portions of the UTP dielectric according to the invention.

The box may be provided with two or more protrusions.

LIST OF REFERENCE SIGNS

10A . . . UTP cable
10B . . . STP cable
11 . . . wire
20A . . . UTP connector
20B . . . STP connector
21A . . . UTP connection terminal
21B . . . STP connection terminal
22A . . . UTP dielectric
22B . . . STP dielectric
26 . . . accommodating portion
27 . . . box portion
31 . . . receiving portion
32 . . . resilient contact piece
34 . . . protrusion
53 . . . insertion area
90A . . . mating UTP connector
90B . . . mating STP connector
91 . . . male terminal

The invention claimed is:

1. A connector structure, comprising:

UTP connection terminals each including a box portion into which a male terminal is inserted and connected, the UTP connection terminals being connected to respective wires of a UTP cable;

STP connection terminals each including a box portion into which a male terminal is inserted and connected, the STP connection terminals being connected to respective wires of a STP cable;

a UTP dielectric including accommodating portions for accommodating the UTP connection terminals; and an STP dielectric including accommodating portions for accommodating the STP connection terminals;

a pair of the accommodating portions of the UTP dielectric and a pair of the accommodating portions of the STP dielectric being arranged in a width direction perpendicular to an inserting direction of the male terminals;

the UTP connection terminals having the same shape and being accommodated into the pair of accommodating portions of the UTP dielectric such that insertion areas for the male terminals in the box portions are close to each other in the width direction; and the STP connection terminals having the same shape and being accommodated into the pair of accommodating portions of the STP dielectric such that insertion areas for the male terminals in the box portions are arranged more apart from each other in the width direction than in the case of the UTP connection terminals.

2. A connector structure according to claim 1, wherein:

a receiving portion and a resilient contact piece facing the receiving portion are arranged in the box portion, the resilient contact piece projects more into the box portion than the receiving portion and the male terminal is sandwiched between the receiving portion and the resilient contact piece;

the UTP connection terminals are accommodated in the pair of accommodating portions of the UTP dielectric such that the receiving portions are located on inner sides proximate in the width direction and the resilient contact pieces are located on outer sides spaced apart in the width direction; and the STP connection terminals are accommodated in the pair of accommodating portions of the STP dielectric such that the receiving portions are located on outer sides spaced apart in the width direction and the resilient contact pieces are located on inner side proximate in the width direction.

* * * * *